United States Patent [19]

Mikulecky

[11] Patent Number: 4,611,189

[45] Date of Patent: Sep. 9, 1986

[54] UNDEROIL PRIMARY CIRCUIT BREAKER

[75] Inventor: Harvey W. Mikulecky, Oconomowoc, Wis.

[73] Assignee: RTE Corporation, Brookfield, Wis.

[21] Appl. No.: 699,349

[22] Filed: Feb. 7, 1985

[51] Int. Cl.[4] ..... H01H 75/12; H01H 77/04

[52] U.S. Cl. ..... 335/37; 200/150 B; 200/150 D

[58] Field of Search ..... 335/37; 200/150 B, 150 D, 200/150 E; 361/37

[56] References Cited

U.S. PATENT DOCUMENTS 2,095,729 10/1937 Beiersdorf ..... 200/150 B 3,584,171 6/1971 Pucher ..... 200/150 B

*Primary Examiner*—Harold Broome

*Attorney, Agent, or Firm*—Ronald E. Barry

[57] ABSTRACT

An underoil primary circuit breaker having a fixed contact assembly and a rod contact, a trip-free latch mechanism for moving the rod contact toward and away from the fixed contact, a temperature responsive magnetically controlled trip assembly for releasing the latch mechanism, and cross blast car interrupter for extinguishing the arc produced between the rod contact and fixed contact assembly, the interrupter including a core formed from an arc extinguishing material and defining within a reinforced case a pressure chamber, a pressure relief chamber, an arc passage connected to the pressure chamber and a vent passage connected to the vent chamber; high and low pressure exhaust ports are provided between the arc passage and the vent passage and a throttling tube is provided in the pressure relief chamber to vent gases into the transformer.

19 Claims, 18 Drawing Figures

UNDEROIL PRIMARY CIRCUIT BREAKER

BACKGROUND OF THE INVENTION

In my earlier issued U.S. Pat. No. 4,435,690, issued on Mar. 6, 1984, a primary circuit breaker was disclosed which provided both primary and secondary current interruption for both extended overloads and fault currents. The circuit breaker was externally operable and resettable. The temperature sensing system was responsive to fault current in the primary winding and to increases in the temperature of the insulating oil due to overloads or incipient faults.

SUMMARY OF THE INVENTION

In the present application, a primary circuit breaker is disclosed, which is also immersible in the insulating oil and operable externally from the transformer. The breaker is temperature sensitive and responds to both the primary and secondary fault currents and/or incipient faults in the system. The arc interrupting chamber has been improved to provide better control of the pressure generated within the arc chamber whether from primary or secondary faults. The arc chamber also provides for control of venting of the gases into the transformer so as to minimize the oil hammer effect produced by high pressure gases. A electrically conductive metal nonmagnetic plate is provided adjacent the overcurrent sensing element to prevent violent arcing within the transformer by shorting the arc of the sensing element under a high primary fault current to the plate, thus producing a very short arc and minimal violence within the chamber. An improved stationary contact assembly is provided within the arc interrupter to minimize welding between the stationary contact and the moveable contact under fault close-in conditions. A mounting arrangement has been provided for the stationary contact to reduce the force required to break small welds if they have occurred during fault close-in. Cross-blast gases used to extinguish the arc are confined to a small portion of the arc passage under secondary fault conditions and extended to generally provide a cross-blast across the entire arc under a primary fault condition.

IN THE DRAWING

DESCRIPTION OF THE INVENTION

Figure 1:
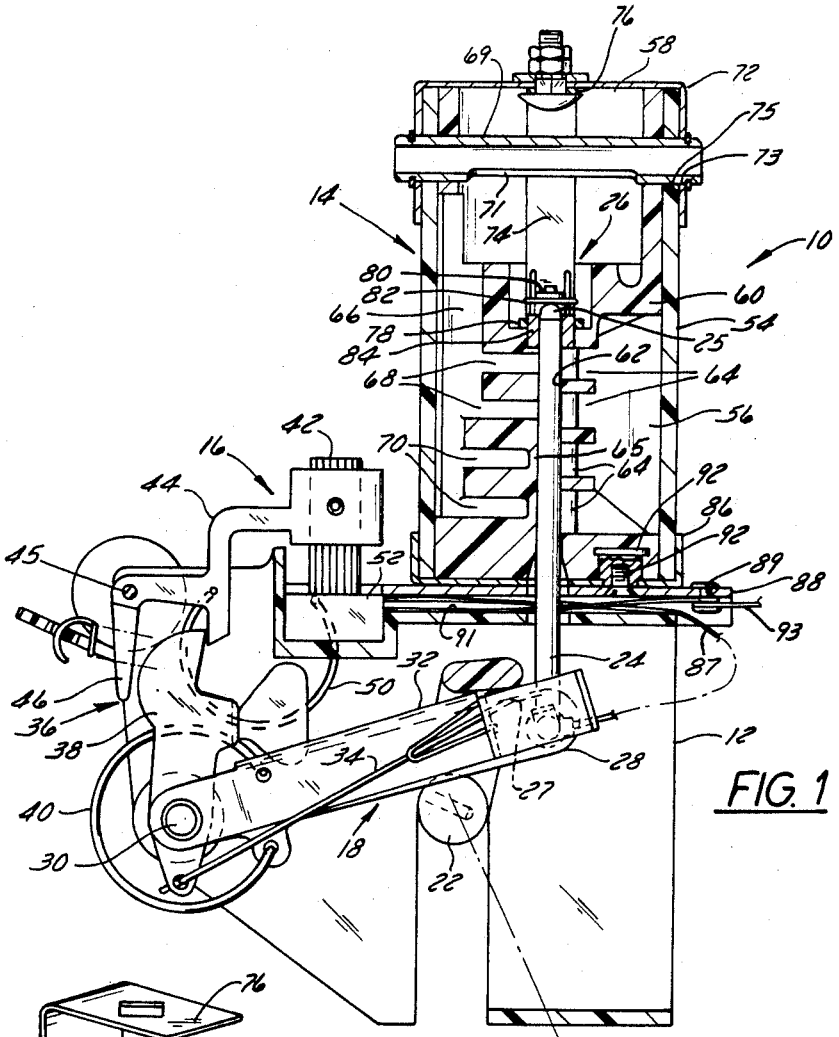
FIG. 1 is a side elevation view in section of the primary circuit breaker according to the present invention.

The primary circuit breaker 10 as seen in FIG. 1 generally includes a frame or base 12, an arc interrupting assembly 14, a trip assembly 16 and a trip-free latch mechanism 18. The latch mechanism 18, as described in my earlier U.S. Pat. No. 4,435,690, can be used to manually open and close the circuit breaker externally of the transformer. This is accomplished by means of an actuating handle 20 connected to a crankshaft 22 as described in the above patent.

The operation of the latch mechanism is also essentially the same as disclosed in my earlier patent. In this regard, refer to FIG. 1, the circuit breaker 10 is opened and closed by moving conductive rod 24 into and out of engagement with the contact assembly 26 located within the arc interrupting assembly 14 by means of the latch mechanism 18. The contact rod 24 is provided with an arc tip 25 that has a curved surface 27 and is movable into engagement with the contact assembly 26.

The latch mechanism includes a first lever arm 28 operably connected to the rod 24 and pivotally mounted on a shaft 30 in the housing. A second lever arm 32 is also pivotally mounted on the shaft 30 and supports a rod 34 for movement into engagement with the arm 28 to lock the two arms together. Under normal operating conditions the circuit breaker is opened and closed by moving the arms 28 and 32 simultaneously between the open and closed positions.

The second lever arm is released from the first lever arm by means of a trip assembly 36 which includes a trip lever 38 pivotally mounted on the pin 30 and operably connected to the rod 34. It should be apparent that upon rotation of the lever 38 clockwise, the rod 34 will be pulled away from the catch ledge 27 on the first arm 28 which is biased clockwise by a spring 40 to move the rod 24 away from the contact 26.

Figure 3:
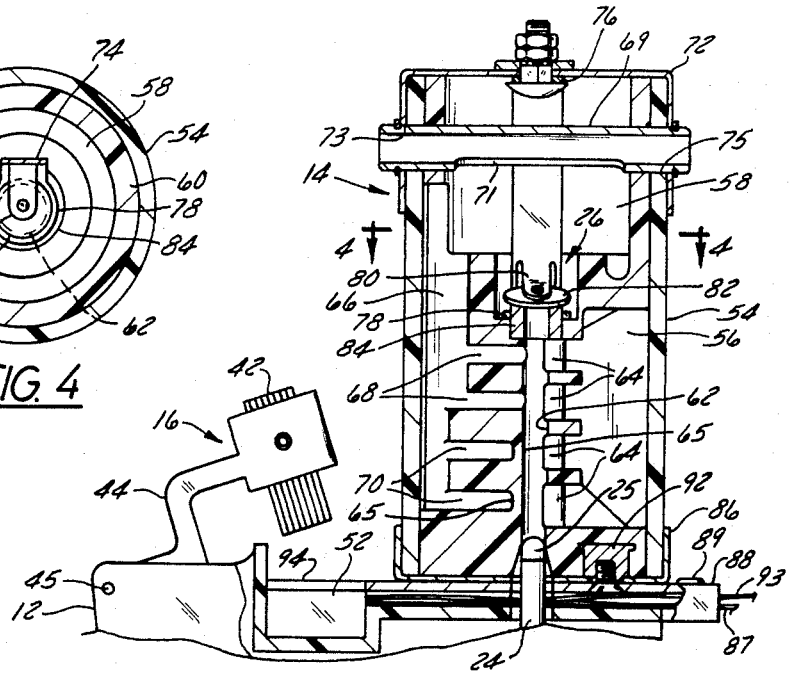
FIG. 3 is a view of the arc extinguishing assembly showing the rod contact in the full open position.
Figure 6:
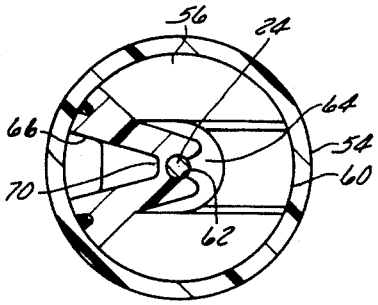
FIG. 6 is a view taken on line 6—6 of FIG. 5 showing the cross-section through one of the primary fault exhaust passages.

The lever arm 38 is tripped by means of the current sensing assembly 16 which includes a magnet 42 mounted on the end of a crank arm 44 which is pivotally mounted on a pin 45 on the base 12. The crank arm 44 includes a depending member 46 which is positioned to engage the lever arm 38. The arm 44 is biased in a counterclockwise direction by means of a spring 50 to move the magnet 42 to an open position as seen in FIG. 3. The member 46 on the end of arm 44 will move into engagement with the lever arm 38 when the magnet is released from the current sensing element 52. The magnet 42 is released from the sensing element 52 when the element 52 reaches the Curie temperature of the magnet. The operation of the sensing assembly 16 is essentially the same as required to operate the primary circuit breaker in U.S. Pat. No. 4,435,690.

In accordance with the present invention, the arc interrupting assembly 14 is provided with means to reduce oil hammer within the transformer upon tripping the circuit breaker under overload or primary fault conditions. The arc interrupter assembly 16 generally includes a tubular housing 54 having a core 60 which divides the housing into a first or pressure chamber 56 and a second or pressure relief chamber 58. Whenever an arc is established between the contacts, the vaporized oil will increase the pressure in chamber 56. The pressurized oil vapor will be discharged across the arc and pass into chamber 58 for discharge into the transformer.

Referring to FIGS. 7–14, the core 60 is formed from a dielectric material which may be arc extinguishing and includes a central arc passage or bore 62 which is connected to the pressure chamber 56 by means of a number of ports 64. The pressure chamber is connected to the relief chamber 58 by means of a first vent passage 66 which is connected to the arc passage 62 by means of low pressure exhaust ports 68 and high pressure exhaust ports 70. The high pressure ports 70 are closed by means of frangible members 65.

Figure 5:
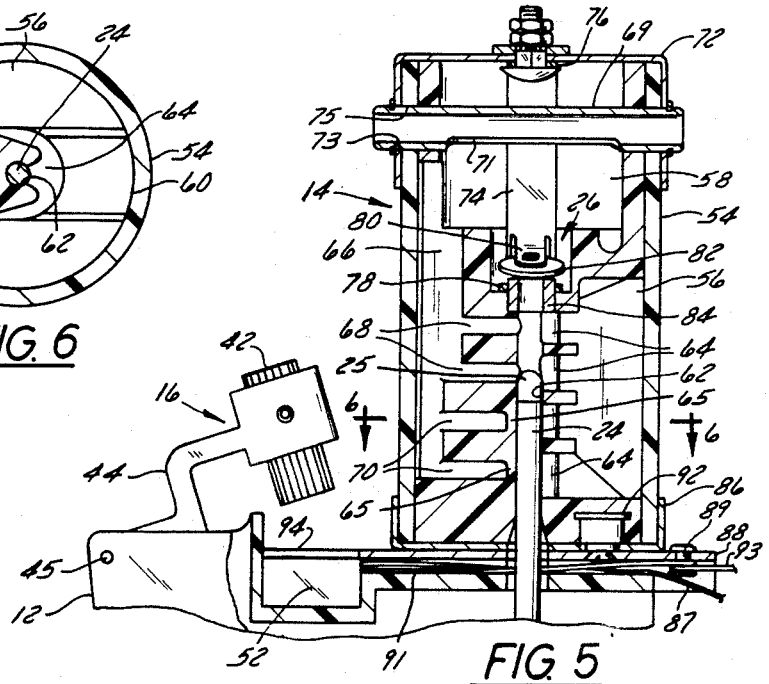
FIG. 5 is a view similar to FIG. 3 showing the rod contact partially opened in the arc passage.
Figure 9:
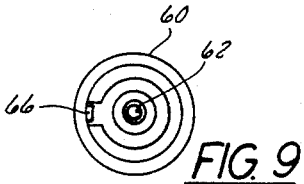
FIG. 9 is a top view of the arc interrupter core shown in FIG. 8.
Figure 12:
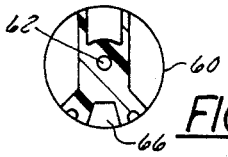
FIG. 12 is a view taken on line 12—12 of FIG. 11 showing the vent passage.
Figure 7:
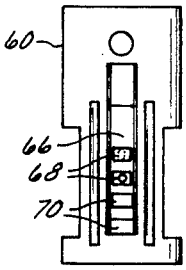
FIG. 7 is a front view of the arc interrupter core.
Figure 8:
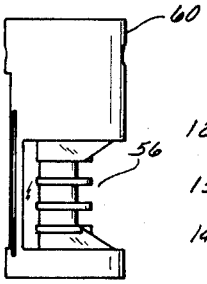
FIG. 8 is a sideview of the arc interrupter core.
Figure 11:
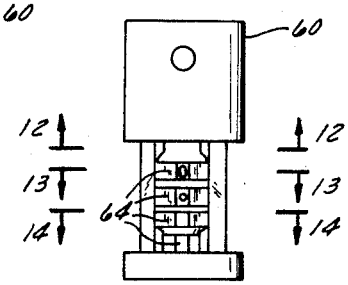
FIG. 11 is a view in elevation of the arc interrupter core showing the expansion chamber.
Figure 10:
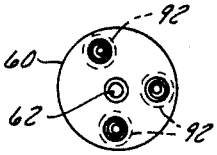
FIG. 10 is a bottom view of the arc interrupter core shown in FIG. 8.
Figure 13:
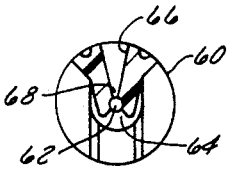
FIG. 13 is a view taken on line 13—13 of FIG. 11.
Figure 14:
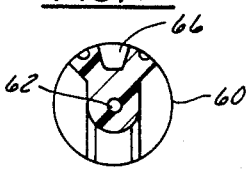
FIG. 14 is view taken on line 14—14 of FIG. 11.
Figure 16:
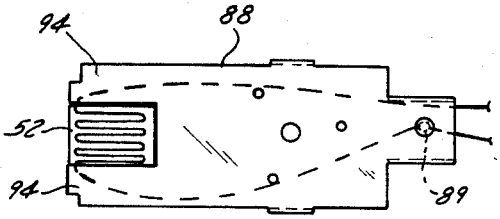
FIG. 16 is a top view of the bypass plate showing the electrical connection of the sensing element of the plate section.

In this regard, the gases produced under low pressure fault conditions will be discharged through ports 68 which are opened as the rod contact moves away from the contact 82 as seen in FIG. 5. Under primary fault conditions, the frangible members 65 will break, allowing the gases to discharge across the full length of the passage 62.

The release of gases from the relief chamber 58 is controlled by means of a tubular member 69 that is supported in openings 75 and extends across the relief chamber. The gases are discharged through a vent slot 71 into the member 69. Gases will thus enter the tubular member 69 through slot 71 and be diverted out through the ends of the member 69 into the transformer.

Figure 2:
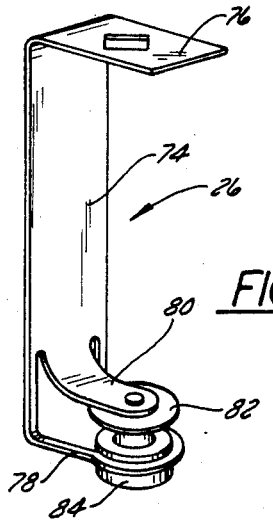
FIG. 2 is a perspective view of the stationary contact assembly.
Figure 4:
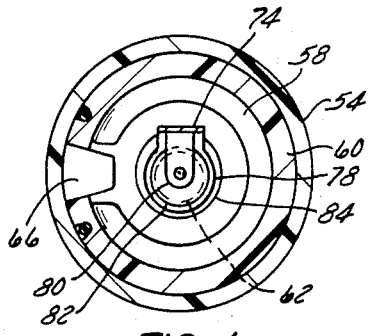
FIG. 4 is a view taken on line 4—4 of FIG. 3 showing the fixed contact assembly in the relief chamber.

The upper end of the interrupter assembly is closed by a metal cap 72 which is retained on the cylindrical housing 54 by means of the tubular member 69 which passes through openings 73 provided in the cap which are coaxial with the openings 75 in the cylindrical member 54. The stationary contact assembly 26 is supported within the pressure chamber 58 by means of the metal cap 72. In this regard, the contact assembly 26, FIG. 2, includes a conductive strip 74 which is bent at the upper end to form a mounting flange 76 and at the lower end to provide a support flange 78. A short strip 80 is bent upwards from the flange 78 to form a resilient support for the electric contact 82. An electrically conductive arc electrode ring 84 is supported by a flange 78.

Figure 15:
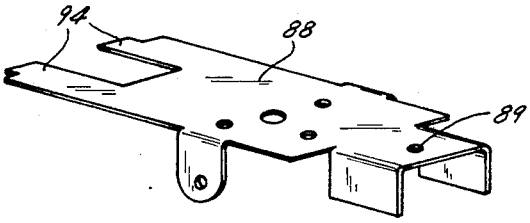
FIG. 15 is a perspective view of the nonmagnetic metal bypass plate.

With this arrangement, several novel features for the transformer primary device is provided by the contact assembly 26. It should be noted that relatively low forces are available to actuate the device. It is, therefore, essential that contact welding not occur between the contact assembly and the rod 24. If the two contact members, contact 82 and rod 24, are made of good arc resistant material such as copper tungston, welding may occur on abutting under fault close-in conditions. Welding is prevented first by means of an arc electrode ring 84 which is located in a position to strike an arc as the rod 24 moves through the opening in the ring. The main contact area at the end of the rod, is therefore protected from arcing with the main contact 82. When the rod 24 completes its full travel, the end of the rod will make full contact with contact 82 to establish a permanent current path. Since the contact 82 is supported at a slight angle on spring member 80, a slight rotation will occur as the rod contacts the contact 82. If a weld does occur, this slight rotation on disconnection will break the weld. The lower end of the arc interrupter assembly is closed by means of a cap 86 which is adhesively secured to the cylindrical housing 54. The interrupter is secured to a nonmagnetic electrically conductive metal plate 88 (FIG. 15) such as stainless steel or an aluminum alloy, by means of screws 90 which are secured to inserts 92 seated in the bottom of the core 60. The plate 88 is mounted on the housing 12 with the legs 94 positioned on each side of the temperature sensing element 52.

The temperature sensing element 52 is in the form of a folded coil having insulation provided between the coils. One end of the element 52 is connected to the rod 24 by an insulated conductor 87 and the other end is connected to a screw in opening 89 at the end of the plate 88 by a conductor 91. The transformer primary winding is also connected to the screw in the opening 89 by a conductor 93.

The metal plate 88 also provides additional functions in the operations of the interrupter. In this regard, it should be noted that the extended legs 94 are located in close proximity to the sensing element 52. Under high primary fault conditions, the element 52 (especially for low kva transformers) will probably melt which would normally produce a violent arc within the transformer, increasing the chance of damaging the transformer primary circuit breaker assembly, as well as producing additional shock forces in the failing transformer. The location of the legs 94 in close proximity to the sensing element 52 will provide a shorting bypass for any arc originating from the failing element resulting in a very short arc and minimal violence. The arc will be shorted through the plate 88 directly to conductors 93.

Figure 17:
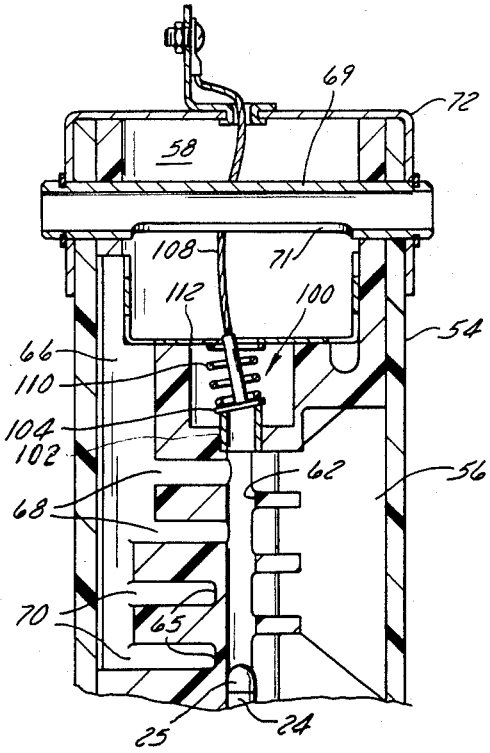
FIG. 17 is a view of an alternate form of stationary assembly.
Figure 18:
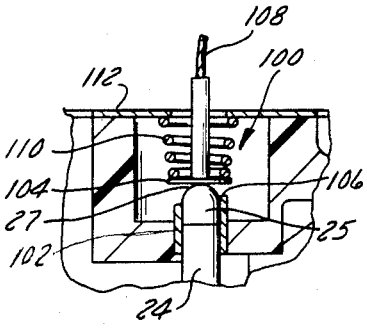
FIG. 18 is an enlarged view of the contact assembly shown in FIG. 17 with the movable contact in engagement with the fixed contact.

In FIGS. 17 and 18 an alternate contact assembly 100 is shown which includes an arcing ring 102 and a contact member or pad 104. The contact movable rod contact 24 is moved into engagement with pad 104 through the arcing ring 102 as described above.

The contact ring 102 is provided with an offset surface 106. The contact pad 104 is supported on an electrically conductive cable 108 in a position to rest on the surface 106 of the ring 102. Means are provided for biasing the pad 104 into engagement with the arc ring 102. Such means is the form of a compression spring positioned between the pad 104 and a hold-down bracket 112 seated in the relief chamber 58. The contact pad 104 being offset from the axis of the ring 102 when seated on the surface 106. When the arc tip 15 on the rod 24 engages the member 104, the spring 110 will square the member 104 on the end of the surface 27. When the rod 14 is moved away from the pad, the pad 104 will tilt on the arc tip 25 when the pad engages the arc ring 106 to break any welds that may develop on engagement with the rod 24.

The embodiments of the invention in which an exclusive property or privilege is claimed, are defined as follows:

1. An arc interruption assembly for an oil immersible primary circuit breaker having a fixed contact, a movable contact, and a trip-free latch mechanism for moving said movable contact into engagement with said fixed contact, said interruption assembly comprising a casing having a core defining first and second chambers within said casing, and an arc passage in said core connected to said first chamber, said fixed contact being located at one end of said arc passage and the movable contact being mounted in said arc passage for movement into engagement with the fixed contact, a second passage in said core connected to said second chamber, a first exhaust port connecting said arc passage to said second passage, a second exhaust port connecting said arc passage to said second passage and frangible means in said second exhaust port for opening said second exhaust port in response to high pressure gases created by a primary fault arc in said interrupter and means in said second chamber for venting low pressure gases from said second chamber.

2. The assembly according to claim 1 wherein said frangible means comprises a disc formed from said core.

3. The assembly according to claim 1, or 2 wherein said venting means comprises a hollow tube positioned in said second chamber and a slot in said tube to throttle high pressure gases on discharge from said second chamber.

4. The assembly according to claim 1, or 2 wherein said case is formed from an arc extinguishing material.

5. An arc interruption assembly for an oil immersible primary circuit breaker having a fixed contact, a movable contact, and a trip-free latch mechanism for moving said movable contact into engagement with said fixed contact, said interruption assembly comprising a casing having a core defining first and second chambers within said casing, and an arc passage in said core connected to said first chamber, said fixed contact being located at one end of said arc passage and the movable contact being mounted in said arc passage for movement into engagement with the fixed contact, a second passage in said core connected to said second chamber, a first exhaust port connecting said arc passage to said second passage, a second exhaust port connecting said arc passage to said second passage and frangible means in said second exhaust port for opening said second exhaust port in response to high pressure gases created by a primary fault arc in said interrupter and means in said second chamber for venting low pressure gases from said second chamber, the fixed contact includes a conductive strip having one end bent to form a contact flange, a conductive ring mounted on said flange and located in the path of travel of the rod in the arc passage, and an electric contact supported on said strip in the path of travel of said rod whereby said rod passes through the arc ring before engaging the contact.

6. The assembly according to claim 5 wherein said strip includes a bias means for supporting said contact.

7. An underoil primary circuit breaker having a fixed contact assembly, a rod contact, a trip-free latch mechanism for moving the rod contact toward or away from said fixed contact assembly, and a trip assembly for releasing said latch mechanism in response to primary and/or secondary fault currents, the improvement comprising a gas blast arc interrupter mounted on said circuit breaker, said interrupter including a tubular casing, a cap on each end of said casing, a core positioned in said casing and defining a pressure chamber and a pressure relief chamber therein, an arc passage in said core connected to said pressure chamber, a vent passage in said core connected to said pressure relief chamber and high and low pressure exhaust ports connecting said arc passage to said vent passage whereby arc generated gases in said pressure chamber will flow across the arc passage on discharge through said exhaust ports to said vent passage, said pressure relief chamber includes means for throttling the gases flowing out of the relief chamber.

8. The circuit breaker according to claim 7 wherein said throttling means comprises a hollow tube extending through said relief chamber for discharging gases into the transformer and a pressure relief slot in said tube.

9. The circuit breaker according to claim 7 wherein said core is made of an arc extinguishing material.

10. An underoil primary circuit breaker having a fixed contact assembly, a rod contact, a trip-free latch mechanism for moving the rod contact toward or away from said fixed contact assembly, and a trip assembly for releasing said latch mechanism in response to primary and/or secondary fault currents, the improvement comprising a gas blast arc interrupter mounted on said circuit breaker, said interrupter including a tubular casing, a cap on each end of said casing a core positioned in said casing and defining a pressure chamber and a pressure relief chamber therein, an arc passage in said core connected to said pressure chamber, a vent passage in said core connected to said pressure relief chamber and high and low pressure exhaust ports connecting said arc passage to said vent passage whereby arc generated gases in said pressure chamber will flow across the arc passage on discharge through said exhaust ports to said vent passage, said trip assembly includes a sensing element connected to respond to both primary and secondary faults, and a magnet positioned to respond to the temperature of the element, said magnet being released when the sensing element approaches the Curie temperature of the magnet.

11. The circuit breaker according to claim 10 including an electrically conductive non-magnetic member mounted on the circuit breaker and having one end located in close proximity to said sensing element and the other end adapted to be connected to the primary winding of a transformer whereby said member provides an arc shorting bypass from the sensing element to the primary winding.

12. An arc interrupter comprising a casing including a reinforced tubular housing and a metal cap on each end of said housing, a core formed from an arc extinguishing material positioned within said casing and defining a pressure chamber, a pressure relief chamber, an arc passage connected to said pressure chamber and a vent passage connected to said relief chamber, a first set of low pressure exhaust ports connecting said arc passage to said vent passage and a second set of high pressure exhaust ports connecting said arc passage to said vent passage and pressure responsive frangible means in said second set of exhaust ports, said frangible means responding to primary fault arc generated high pressure gas to open said second set of exhaust ports.

13. The interrrupter according to claim 12 including pressure throttling means in said relief chamber for discharging gases from said interrupter.

14. An arc interruption assembly for an oil immersible primary circuit breaker having a fixed contact assembly, a movable contact, a trip-free latch mechanism for moving the rod contact into engagement with the fixed contact and a magnetic trip assembly which is responsive to the Curie temperature of a magnet, said interrupter assembly comprising a casing having a core defining an expansion chamber and a pressure relief chamber within said casing, an arc passage in said core operatively connected to said pressure relief chamber, the fixed contact being located at one end of said arc passage and the movable contact being mounted for reciprocal motion in said arc passage for movement into engagement with the fixed contact, a vent passage in said core connected to said relief chamber, a discharge tube in said relief chamber for discharging high pressure fluids from said pressure chamber, a first set of low pressure ports connecting said arc passage to said vent passage and a second set of high pressure ports connecting the arc passage to the vent passage whereby gases generated in said expansion chamber will flow across the arc passage.

15. The assembly according to claim 14 wherein said second set of ports includes means responsive to high pressure gases in said relief chamber for opening said second set of ports.

16. The assembly according to claim 14 or 15 wherein said discharge tube includes a slot to throttle high pressure gases on discharge from said pressure relief chamber.

17. An underoil primary circuit breaker having a fixed contact assembly and a rod contact, a trip-free latch mechanism for moving the rod contact toward or away from said fixed contact assembly, and a trip assembly for releasing said latch mechanism in response to a primary and/or secondary fault condition, and a gas blast arc interrupter mounted on said circuit breaker, said interrupter including a tubular casing, a core positioned in said casing and defining a pressure chamber and a pressure relief chamber therein, an arc passage in said core connected to said pressure chamber, and a vent passage in said core connected to said pressure relief chamber, high and low pressure ports in said core connecting said arc passage to said vent passage whereby high pressure gases generated in said pressure chamber will flow across the arc passage on discharge through said ports to said vent passage, said fixed contact assembly being mounted in said core at the end of said arc passage and including an electrically conductive contact and means for supporting said contact in the path of motion of said rod.

18. The assembly according to claim 17 wherein said supporting means includes a conductive strip having one end bent to form a contact flange, and a conductive arc ring mounted on said flange and located in the path of travel of the rod in the arc passage, said electric contact being supported on said strip in axial alignment with said ring whereby said rod passes through the arc ring before engaging the contact.

19. The assembly according to claim 17 wherein said supporting means comprises a flexible cable for supporting said contact in the path of motion of said rod, and an arc ring mounted in said core at the end of said arc passage, said arc ring having an offset contact surface and means for biasing said contact into engagement with said offset surface.

* * * * *